US012084960B2

(12) United States Patent
Li et al.

(10) Patent No.: US 12,084,960 B2
(45) Date of Patent: Sep. 10, 2024

(54) METHOD FOR SYNCHRONIZING AZIMUTH DETECTION DATA WHILE DRILLING AND DEVICE FOR AZIMUTH DETECTION WHILE DRILLING

(71) Applicant: INSTITUTE OF GEOLOGY AND GEOPHYSICS, CHINESE ACADEMY OF SCIENCES, Beijing (CN)

(72) Inventors: Hong Li, Beijing (CN); Wenxiu Zhang, Beijing (CN); Wenxuan Chen, Beijing (CN); Yali Zhang, Beijing (CN); Wei Liu, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 18/033,474

(22) PCT Filed: Dec. 20, 2022

(86) PCT No.: PCT/CN2022/140303

§ 371 (c)(1),
(2) Date: Apr. 24, 2023

(87) PCT Pub. No.: WO2023/197663

PCT Pub. Date: Oct. 19, 2023

(65) Prior Publication Data

US 2024/0271521 A1 Aug. 15, 2024

(30) Foreign Application Priority Data

Apr. 15, 2022 (CN) ..... 202210398349.X

(51) Int. Cl.
*E21B 47/022* (2012.01)

(52) U.S. Cl.
CPC ..... *E21B 47/022* (2013.01)

(58) Field of Classification Search
CPC ..... E21B 47/022
(Continued)

(56) References Cited

U.S. PATENT DOCUMENTS 3,546,478 A * 12/1970 Lindsey ..... E21B 47/022 346/107.1
4,452,075 A * 6/1984 Bockhorst ..... E21B 7/068 33/312

(Continued)

FOREIGN PATENT DOCUMENTS

CN 108592949 A 9/2018
CN 110716893 A 1/2020
CN 114755742 A 7/2022

OTHER PUBLICATIONS

International Search Report of PCT/CN2022/140303.
Written Opinion of PCT/CN2022/140303.

*Primary Examiner* — George B Bennett

(57) ABSTRACT

The present disclosure provides a method and device for synchronizing azimuth detection data while drilling. The method includes: starting, by a control module, according to a command that measurement has been started sent by a tool face angle measurement module, a timer to record a first time, and sending, by the control module, a detection signal acquisition starting command to a detection signal acquisition module; performing, by the detection signal acquisition module, a parameter configuration according to the detection signal acquisition starting command, and sending, by the detection signal acquisition module, a command that work has been started to the control module based on a configuration completion state; stopping the timer and recording a second time by the control module according to the command that work has been started.

11 Claims, 3 Drawing Sheets

(58) Field of Classification Search
USPC ..... 33/304
See application file for complete search history.

(56) References Cited

U.S. PATENT DOCUMENTS

| | | | | |
|---|---|---|---|---|
| 4,873,522 | A * | 10/1989 | Jurgens | E21B 47/022 702/6 |
| 5,331,578 | A * | 7/1994 | Stieler | G01C 21/188 73/866.5 |
| 5,467,083 | A * | 11/1995 | McDonald | E21B 47/13 340/854.6 |
| 7,466,136 | B2 * | 12/2008 | Chen | G01V 3/265 324/354 |
| 9,963,936 | B2 * | 5/2018 | Kruspe | E21B 47/095 |
| 10,371,851 | B2 * | 8/2019 | Wu | E21B 49/00 |
| 10,626,716 | B2 * | 4/2020 | Hay | E21B 47/022 |
| 10,760,341 | B2 * | 9/2020 | Gorrara | E21B 47/022 |
| 10,989,037 | B2 * | 4/2021 | Papouras | E21B 44/02 |
| 10,995,604 | B2 * | 5/2021 | Hornblower | E21B 7/04 |
| 11,692,432 | B2 * | 7/2023 | Phillips | E21B 44/00 175/24 |
| 2008/0137474 | A1 | 6/2008 | Dashevskiy et al. | |
| 2016/0123137 | A1 | 5/2016 | Liu et al. | |
| 2021/0348490 | A1 * | 11/2021 | Wheatley | E21B 47/02 |
| 2021/0348502 | A1 | 11/2021 | Xue et al. | |
| 2023/0243251 | A1 * | 8/2023 | Hisham | E21B 47/024 175/24 |
| 2024/0026769 | A1 * | 1/2024 | Chen | E21B 44/00 |
| 2024/0151872 | A1 * | 5/2024 | Zhang | E21B 47/024 |

* cited by examiner

METHOD FOR SYNCHRONIZING AZIMUTH DETECTION DATA WHILE DRILLING AND DEVICE FOR AZIMUTH DETECTION WHILE DRILLING

CROSS-REFERENCE TO RELATED APPLICATIONS

This application is a bypass continuation application of PCT application no.: PCT/CN2022/140303. This application claims priorities from PCT Application PCT/CN2022/140303, filed Dec. 20, 2022, and from Chinese patent application 202210398349.X filed Apr. 15, 2022, the contents of which are incorporated herein in the entirety by reference.

TECHNICAL FIELD

The present disclosure relates to the field of geological exploration technologies, and in particular, to a method for synchronizing azimuth detection data while drilling and a device for azimuth detection while drilling.

BACKGROUND

Logging while drilling (LWD) is a technology that measures petrophysical parameters of a surrounding formation in real time while a drill bit is drilling through the formation, and plays an increasingly important role in modern oil and gas exploration and development because of its advantages of more real data, more timely measurement, higher measurement precision, etc.

Conventional LWD instruments can realize detection of down-hole one-dimensional information, but can only obtain a total field curve and cannot be used for geosteering in complex formations. However, due to addition of an azimuth detection module to an instrument for azimuth detection while drilling, measurement results of the instrument for azimuth detection while drilling have azimuth characteristics, and through the rotation of a drilling tool, well circumference data is measured in real time and a two-dimensional image is obtained, thereby precisely locating a reservoir.

The azimuth detection module of the instrument for azimuth detection while drilling needs to acquire a tool face angle and corresponding detection data of the well circumference at the same time and has a control circuit which mainly includes two parts, i.e., a tool face angle measurement part and a detection signal acquisition part. However, it is difficult to achieve precise synchronization control as the two acquisition modules are independent of each other. If the precise control of azimuth detection cannot be achieved, it will lead to a location error in azimuth detection, and thus accurate information about the formation cannot be obtained.

Therefore, how to solve the above problems has become a technical problem urgently to be solved by those skilled in the art.

SUMMARY

Objects of the present disclosure are to provide a method and device for synchronizing azimuth detection data while drilling, which at least can solve the above problems.

For solving the above problems, the present disclosure provides a method for synchronizing azimuth detection data while drilling. The method includes: starting, according to a command that measurement has been started sent by a tool face angle measurement module, by a control module, a timer to record a first time, and sending, by the control module, a detection signal acquisition starting command to a detection signal acquisition module;

performing, by the detection signal acquisition module, a parameter configuration according to the detection signal acquisition starting command, and sending, by the detection signal acquisition module, a command that work has been started to the control module based on a configuration completion state;

stopping the timer and recording a second time by the control module according to the command that work has been started; and calculating a deviation angle according to a time difference between the first time and the second time, and correcting the tool face angle measurement module based on the deviation angle.

In some embodiments, the method further includes: sending, by the control module, a measurement starting command to the tool face angle measurement module based on a received data acquisition command; and performing, by the tool face angle measurement module, a parameter configuration according to the measurement starting command, and sending, by the tool face angle measurement module, the command that measurement has been started to the control module based on a configuration completion state.

In some embodiments, the first time is recorded as Tstart and the second time is recorded as Tend; a communication protocol set between the control module and the tool face angle measurement module and a communication protocol set between the control module and the detection signal acquisition module are the same; and the time difference satisfies a conditional formula: Tdiff=Tend−Tstart.

In some embodiments, the first time is recorded as Tstart and the second time is recorded as Tend; a communication protocol set between the control module and the tool face angle measurement module is different from a communication protocol set between the control module and the detection signal acquisition module; and the time difference satisfies a conditional formula: Tdiff=Tend−Tstart−Tran2+Tran1, where Tran1 denotes a time when the tool face angle, measurement module uploads the command that measurement has been started to the control module and decoding is performed, and Tran2 denotes a time when the detection signal acquisition module uploads the command that work has been started to the control module and decoding is performed.

In some embodiments, the deviation angle is recorded as $\theta$, and satisfies a conditional formula: $\theta=\omega t$, where $\omega$ denotes an angular speed and t=Tdiff.

In some embodiments, the correcting the tool face angle measurement module based on the deviation angle includes:

performing correction by synchronously subtracting the angle $\theta$ based on data uploaded by the tool face angle measurement module within a preset time to realize synchronization of tool face angle data and detection signal data.

A second aspect of embodiments of the present disclosure provides a device for azimuth detection while drilling, including a control module, a tool face angle measurement module and a detection signal acquisition module, wherein the control module starts, according to a command that measurement has been started sent by the tool face angle measurement module, a timer to record a first time, and sends a detection signal acquisition starting command to the detection signal acquisition module;

the detection signal acquisition module performs a parameter configuration according to the detection signal acquisition starting command, and sends a command that work has been started to the control module based on a configuration completion state; and the control module stops the timer and records a second time according to the command that work has been started; and a deviation angle is calculated according to a time difference between the first time and the second time, and the tool face angle measurement module is corrected based on the deviation angle.

In some embodiments, the control module sends a measurement starting command to the tool face angle measurement module based on a received data acquisition command; and the tool face angle measurement module performs a parameter configuration according to the measurement starting command, and sends the command that measurement has been started to the control module based on a configuration completion state.

In some embodiments, the first time is recorded as Tstart and the second time is recorded as Tend; a communication protocol set between the control module and the tool face angle measurement module and a communication protocol set between the control module and the detection signal acquisition module are the same; and the time difference satisfies a conditional formula: Tdiff=Tend−Tstart.

In some embodiments, the first time is recorded as Tstart and the second time is recorded as Tend; a communication protocol set between the control module and the tool face angle measurement module is different from a communication protocol set between the control module and the detection signal acquisition module; and the time difference satisfies a conditional formula: Tdiff=Tend−Tstart−Tran2+Tran1, where Tran1 denotes a time when the tool face angle measurement module uploads the command that measurement has been started to the control module and decoding is performed, and Tran2 denotes a time when the detection signal acquisition module uploads the command that work has been started to the control module and decoding is performed.

In the present disclosure, the control module starts, according to the command that measurement has been started sent by the tool face angle measurement module, the timer to record the first time, and sends the detection signal acquisition starting command to the detection signal acquisition module. The detection signal acquisition module performs the parameter configuration according to the detection signal acquisition starting command, and sends the command that work has been started to the control module based on the configuration completion state. The control module stops the timer and records the second time according to the command that work has been started. The deviation angle is calculated according to the time difference between the first time and the second time, and the tool face angle measurement module is corrected based on the deviation angle. According to the present disclosure, time recording (the first time and the second time) is triggered based on the commands, which can accurately record a work ending time of the tool face angle measurement module and a work ending time of the detection signal acquisition module. Thus, a time difference between the tool face angle measurement module and the detection signal acquisition module is accurately calculated and the function of correcting a deviation amount (the deviation angle calculated based on the time difference) in real time is achieved to improve the azimuth measurement precision, thereby improving the geosteering precision of while-drilling instruments.

DETAILED DESCRIPTION

Figure 1:
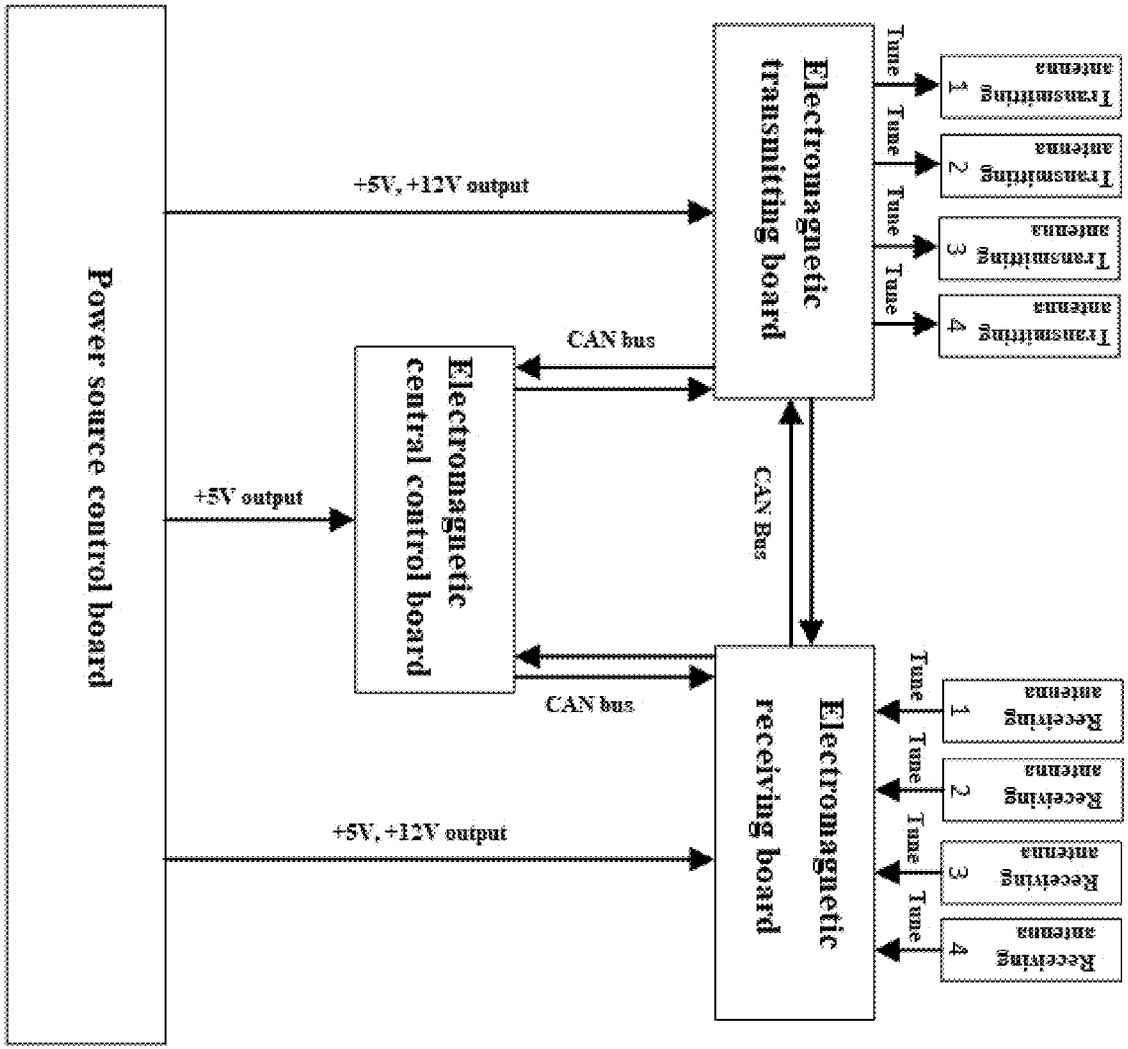
FIG. 1 is a structural diagram of a principle of a device for azimuth detection while drilling according to an embodiment of the present disclosure.

In order to make the objects, technical solutions, and advantages of the present disclosure clearer, the present disclosure is described in further detail below with reference to specific embodiments and the accompanying drawings. It should be understood that the description is merely exemplary and is not intended to limit the scope of the present disclosure. Moreover, in the following description, the description of well-known structures and techniques is omitted to avoid unnecessarily confusing the concept of the present disclosure.

Schematic structural diagrams according to embodiments of the present disclosure are shown in the accompanying drawings. These drawings are not drawn to scale, and some details may be omitted for the purpose of clarity. Various regions, shapes, and the relative sizes and position relationships therebetween shown in the drawings are only illustrative. In practice, there may be deviations due to manufacturing tolerances or technical limitations. Moreover, those skilled in the art can design regions of different shapes, sizes and relative positions additionally according to actual needs.

Obviously, the embodiments described are some but not all embodiments of the present disclosure. Based on the embodiments of the present disclosure, all other embodiments derived by a person of ordinary skill in the art without creative efforts shall fall within protection scope of the present disclosure.

In addition, the technical features involved in the different implementations of the present disclosure described below may be combined with one another as long as they do not conflict with one another.

The present disclosure will be described in more detail below with reference to the accompanying drawings. The same components are denoted by similar reference signs in the respective accompanying drawings. For the sake of clarity, various parts in the accompanying drawings are not drawn to scale.

The measurement precision of an instrument for azimuth detection while drilling is mainly determined by the tool face angle measurement precision, the detection signal acquisition precision, and the synchronization degree of the tool face angle measurement precision and the detection signal acquisition precision. With the rapid development of China's oil logging technology, there are increasing requirements for the precision of LWD instruments. Existing downhole detection instruments can achieve the highest drilling speed of 300 r/nin, and the sector division precision has developed from original 4-sector precision to 8-sector precision, and then to 16-sector precision at present.

Under the requirements of high drilling speed and high precision, it is difficult to satisfy the down-hole detection precision requirements without synchronous processing of tool face angle measurement and detection signal acquisition or only with a synchronous processing method based on a fixed deviation time.

If the tool face angle measurement precision and the detection signal acquisition precision both satisfy the requirements, the down-hole instrument can achieve the highest drilling speed of 200 r/min, and the four-sector division precision (upper, lower, left, right) is used, that is, a rotation angle occupied by one sector is 90 degrees. Under the above conditions, an acquisition signal of this sector will completely deviate to other sectors only if a difference between a measurement starting time of a tool face angle and an acquisition starting time of a detection signal is greater than 75 ms. If the drilling speed increases to 300 r/min and the 16-sector division precision is used, that is, if the rotation angle occupied by one sector is 22.5 degrees, the deviation of signal acquisition data values in sectors can be completed as long as the difference between the measurement starting time of the tool face angle and the acquisition starting time of the detection signal is greater than 12.5 ms. If the synchronous correction of the starting times is not performed, it is prone to cause an azimuth data measurement deviation.

Most of existing correction schemes are correction methods based on a fixed deviation time: the difference between the measurement starting time of the tool face angle and the acquisition starting time of the detection signal is measured under laboratory conditions and recorded as a fixed value for correcting a sector deviation. This has the disadvantage that an impact of the surrounding environment (such as a temperature) on hardware is not considered, and the deviation cannot be corrected in real time.

Figure 2:
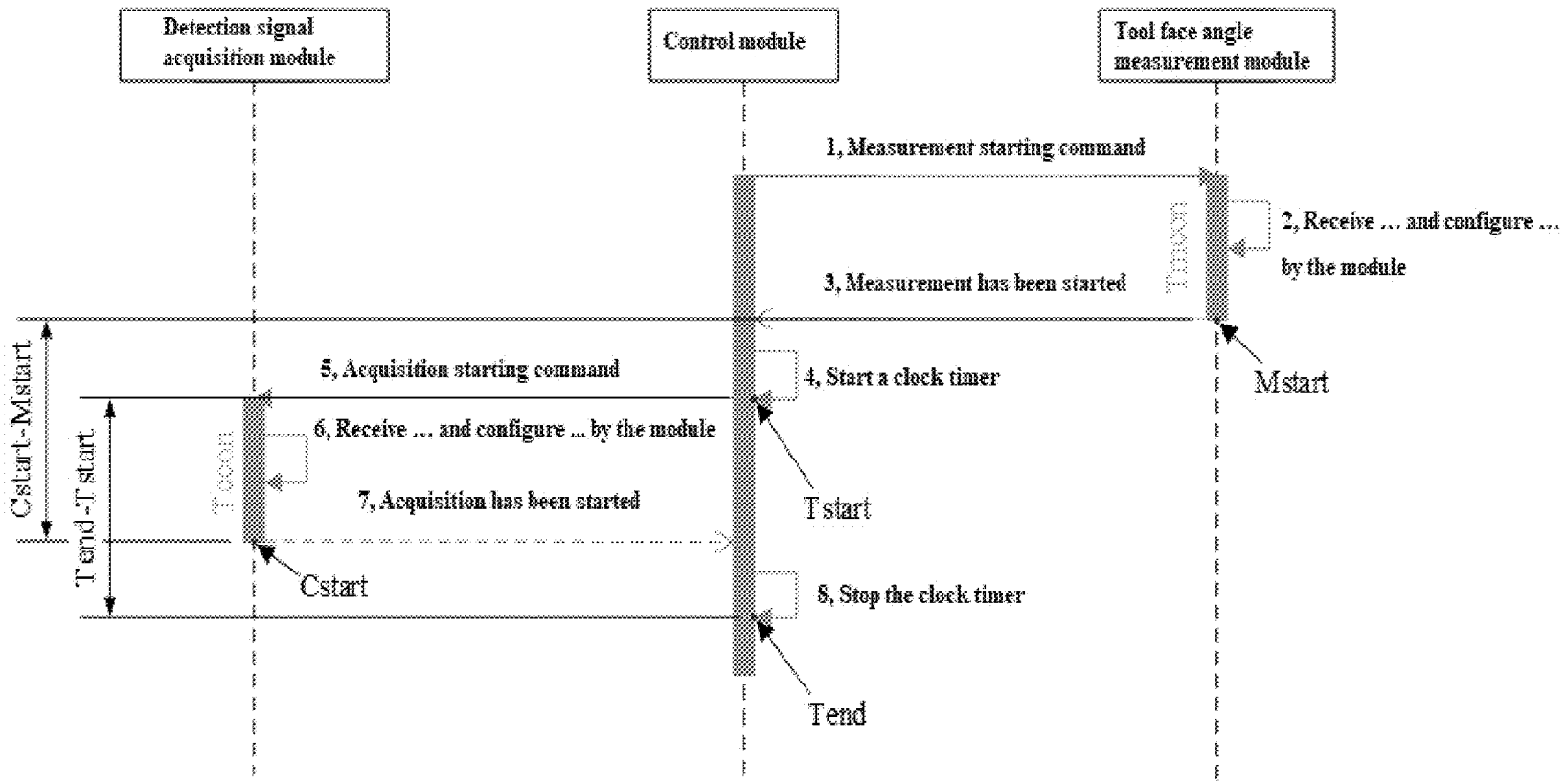
FIG. 2 is a schematic flowchart of a method for synchronizing azimuth detection data while drilling according to an embodiment of the present disclosure.
Figure 3:
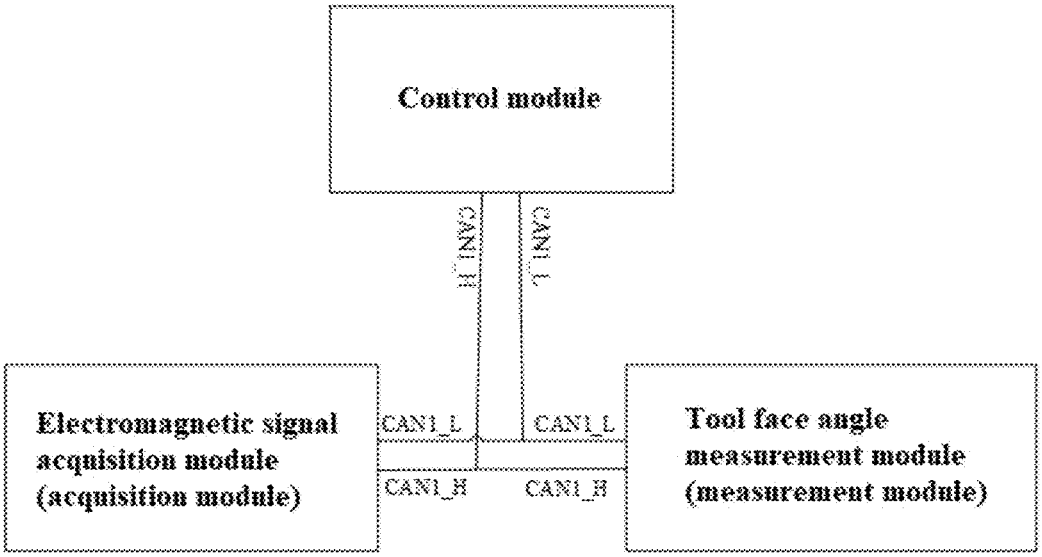
FIG. 3 is a schematic diagram of connection between a control module and each of a tool face angle measurement module and a detection signal module according to an embodiment of the present disclosure.

In an embodiment of the present disclosure, referring to FIGS. 1-3, a method for synchronizing azimuth detection data while drilling is provided. The method includes: S101, starting, according to a command that measurement has been started sent by a tool face angle measurement module, by a control module, a timer to record a first time, and sending, by the control module, a detection signal acquisition starting command to a detection signal acquisition module:

S102, performing, by the detection signal acquisition module, parameter a configuration according to the detection signal acquisition starting command, and sending, by the detection signal acquisition module, a command that work has been started to the control module based on a configuration completion state;

S103, stopping the tinier and recording a second time by the control module according to the command that work has been started; and S104, calculating a deviation angle according to a time difference between the first time and the second time, and correcting the tool face angle measurement module based on the deviation angle.

Further, the control module is respectively connected to the tool face angle measurement module and the detection signal acquisition module. Specifically, the control module is respectively connected to the tool face angle measurement module and the detection signal acquisition module via field buses. The field buses include CAN buses.

In the present disclosure, the control module starts, according to the command that measurement has been started sent by the tool face angle measurement module, the timer to record the first time, and sends the detection signal acquisition starting command to the detection signal acquisition module. The detection signal acquisition module performs a parameter configuration according to the detection signal acquisition starting command, and sends the command that work has been started to the control module based on the configuration completion state. The control module stops the timer and records the second time according to the command that work has been started. The deviation angle is calculated according to the time difference between the first time and the second time, and the tool face angle measurement module is corrected based on the deviation angle. According to the present disclosure, time recording (the first time and the second time) is triggered based on the commands, which can accurately record a work ending time of the tool face angle measurement module and a work ending time of the detection signal acquisition module. Thus, a time difference between the tool face angle measurement module and the detection signal acquisition module is accurately calculated and the function of correcting a deviation amount (the deviation angle calculated based on the time difference) in real time is achieved to improve the azimuth measurement precision, thereby improving the geosteering precision of while-drilling instruments.

In some embodiments, the method further includes: S105, sending, by the control module, a measurement starting command to the tool face angle measurement module based on a received data acquisition command; and S106, performing, by the tool face angle measurement module, a parameter configuration according to the measurement starting command, and sending, by the tool face angle measurement module, the command that measurement has been started to the control module based on a configuration completion state.

In some embodiments, the first time is recorded as Tstart and the second time is recorded as Tend; a communication protocol set between the control module and the tool face angle measurement module and a communication protocol set between the control module and the detection signal acquisition module are the same; and the time difference satisfies a conditional formula: Tdiff=Tend−Tstart.

In some embodiments, the first time is recorded as Tstart and the second time is recorded as Tend; a communication protocol set between the control module and the tool face angle measurement module is different from a communication protocol set between the control module and the detection signal acquisition module; and the time difference satisfies a conditional formula: Tdiff=Tend−Tstart−Tran2+Tran1, where Tran1 denotes a time when the tool face angle measurement module uploads the command that measurement has been started to the control module and decoding is performed, and Tran2 denotes a time when the detection signal acquisition module uploads the command that work has been started to the control module and decoding is performed.

In some embodiments, the deviation angle is recorded as θ, and satisfies a conditional formula: $0=\omega t$, where ω denotes an angular speed and t=Tdiff.

In some embodiments, the correcting the tool face angle measurement module based on the deviation angle includes:

performing correction by synchronously subtracting the angle θ based on data uploaded by the tool face angle measurement module within a preset time to realize synchronization of tool face angle data and detection signal data.

Referring to FIG. 1, the present disclosure provides a device for azimuth detection while drilling. The device includes an electromagnetic transmitting board, an electromagnetic receiving board (including a detection signal acquisition module), an electromagnetic central control board (including a control module and a tool face angle measurement module) and a power source control board. The electromagnetic transmitting board is configured to transmit an electromagnetic wave signal. The electromagnetic transmitting board generates a sine signal according to a time sequence, and emits the electromagnetic wave signal through a transmitting antenna after tuning the sine signal. The electromagnetic receiving board is configured to receive the electromagnetic wave signal emitted by the detection device. After being reflected by a formation, the electromagnetic wave signal is received through a receiving antenna, tuned, and then converted to an electrical signal and the electrical signal is acquired. The electromagnetic central control board is responsible for controlling the time sequence of the electromagnetic transmitting board and processing the signal received by the electromagnetic receiving board, and also needs to complete the control of the device for azimuth detection while drilling and other logging instruments and achieve a function of data interaction between the device for azimuth detection while drilling and software of a host computer. The power source control board is configured to supply power to the electromagnetic transmitting board, the electromagnetic receiving board and the electromagnetic central control board.

In some embodiments, each of the electromagnetic transmitting board, the electromagnetic receiving board and the electromagnetic central control board transmits data and a command through a CAN bus. The electromagnetic receiving board includes the detection signal acquisition module, and the electromagnetic central control board includes the control module and the tool face angle measurement module.

Specifically, the device for azimuth detection while drilling provided by the present disclosure includes the tool face angle measurement module and the detection signal acquisition module. The detection signal acquisition module is configured to acquire signals for detecting formation boundary information and lithology, such as an electromagnetic wave receiving signal and a gamma receiving signal.

Further, the method for synchronizing azimuth detection data while drilling of the present disclosure includes the followings.

(1) The control module in the electromagnetic central control board is disposed to receive and store tool face angle measurement data and detection signal acquisition data, wherein the tool face angle measurement data is obtained by the tool face angle measurement module, and the detection signal acquisition data is calculated by the detection signal acquisition module and includes an amplitude, phase information and a gamma count value of the electromagnetic wave signal.

(2) After receiving the data acquisition command, the control module in the electromagnetic central control board first sends the measurement starting command to the tool face angle measurement module through a communication port 1; and the tool face angle measurement module performs the parameter configuration according to the measurement starting command, directly starts to measure a tool face angle after completing the configuration, and returns a command that measurement has been started to the electromagnetic central control board through the communication port 1, wherein a configuration time of the tool face angle measurement module is recorded as Tmcon, and a measurement starting time of the tool face angle is recorded as Mstart.

(3) After receiving the command that measurement has been started through the communication port 1 and decoding it, the control module in the electromagnetic central control board starts the timer to record a time which is recorded as a first time Tstart, and meanwhile sends a detection signal acquisition starting command to the detection signal acquisition module through a communication port 2.

(4) After receiving the detection signal acquisition starting command, the detection signal acquisition module starts to configure a corresponding channel and receiving mode; starts to acquire a detection signal, which is recorded as Cstart, after completing the configuration, Cstart denoting a starting time point when the detection signal acquisition module starts to acquire the detection signal; and meanwhile returns a command that work has been started to the control module in the electromagnetic central control board through the communication port 2, a configuration time of the detection signal acquisition module being recorded as Tccon.

(5) After receiving the command that work has been started and decoding it, the control module in the electromagnetic central control board stops the timer and records a measurement time, which is recorded as a second time Tend.

(6) If a communication protocol set between the control module in the electromagnetic central control board and the tool face angle measurement module and a communication protocol set between the control module in the electromagnetic central control board and the detection signal acquisition module are the same, that is, protocols of the communication port 1 and the communication port 2 are the same, Tdiff=T1; and as tool face angle measurement and detection signal acquisition are not synchronized at present and the tool face angle measurement is prior to the detection signal acquisition, in order to facilitate correction, a time difference between Tstart and Tend is recorded as T1=Tend−Tstart; and if used communication modes are different, the time difference may be obtained through the formula Tdiff=T1−Tran2+Tran1, where a time difference between Tran1 and Tran2 is a difference of times when command data is transmitted in the two communication modes, Tran1 denotes a time when the tool face angle measurement module uploads the command that measurement has been started to the control module and decoding is performed, and Tran2 denotes a time when the detection signal acquisition module uploads the command that work has been started to the control module and decoding is performed.

(7) A rotating angular speed ωrad/s of an instrument within a preset time (the preset time includes less than is and is recorded as Ts) is obtained and a deviation angle between the tool face angle and the detection signal is calculated according to the formula θ=ωt, where to denotes the angular speed and t=Tdiff.

(8) {TF1-θ. TF2-θ, . . . , TFn-θ} are obtained by synchronously subtracting the angle θ from data {TF1, TF2, . . . , TFn} (measurement angles ITF denote that there are n pieces of tool face angle data) uploaded by the tool face angle measurement module within Ts, thereby realizing synchronization of tool face angle data and detection signal data.

(9) For data measured within a next Ts, operation procedures in steps (2) to (8) are continuously repeated to achieve the purpose of synchronizing the tool face angle data and the detection signal data in real time.

In the present disclosure, the control module starts, according to the command that measurement has been started sent by the tool face angle measurement module, the timer to record the first time, and sends the detection signal acquisition starting command to the detection signal acquisition module. The detection signal acquisition module performs the parameter configuration according to the detection signal acquisition starting command, and sends the command that work has been started to the control module based on the configuration completion state. The control module stops the timer and records the second time according to the command that work has been started. The deviation angle is calculated according to the time difference between the first time and the second time, and the tool face angle measurement module is corrected based on the deviation angle. According to the present disclosure, time recording (the first time and the second time) is triggered based on the commands, which can accurately record a work ending time of the tool face angle measurement module and a work ending time of the detection signal acquisition module. Thus, a time difference between the tool face angle measurement module and the detection signal acquisition module is accurately calculated and the function of correcting a deviation amount (the deviation angle calculated based on the time difference) in real time is achieved to improve the azimuth measurement precision, thereby improving the geosteering precision of while-drilling instruments.

A second aspect of embodiments of the present disclosure provides a device for azimuth detection while-drilling. The device includes a control module, a tool face angle measurement module and a detection signal acquisition module.

The control module starts, according to a command that measurement has been started sent by the tool face angle measurement module, a timer to record a first time, and sends a detection signal acquisition starting command to the detection signal acquisition module.

The detection signal acquisition module performs a parameter configuration according to the detection signal acquisition starting command, and sends a command that work has been started to the control module based on a configuration completion state.

The control module stops the timer and records a second time according to the command that work has been started.

A deviation angle is calculated according to a time difference between the first time and the second time, and the tool face angle measurement module is corrected based on the deviation angle.

In the present disclosure, the control module starts, according to the command that measurement has been started sent by the tool face angle measurement module, the timer to record the first time, and sends the detection signal acquisition starting command to the detection signal acquisition module. The detection signal acquisition module performs the parameter configuration according to the detection signal acquisition starting command, and sends the command that work has been started to the control module based on the configuration completion state. The control module stops the timer and records the second time according to the command that work has been started. The deviation angle is calculated according to the time difference between the first time and the second time, and the tool face angle measurement module is corrected based on the deviation angle. According to the present disclosure, time recording (the first time and the second time) is triggered based on the commands, which can accurately record a work ending time of the tool face angle measurement module and a work ending time of the detection signal acquisition module. Thus, a time difference between the tool face angle measurement module and the detection signal acquisition module is accurately calculated and the function of correcting a deviation amount (the deviation angle calculated based on the time difference) in real time is achieved to improve the azimuth measurement precision, thereby improving the geosteering precision of while-drilling instruments.

In some embodiments, the control module sends a measurement starting command to the tool face angle measurement module based on a received data acquisition command; and the tool face angle measurement module performs a parameter configuration according to the measurement starting command, and sends the command that measurement has been started to the control module based on a configuration completion state.

In some embodiments, the first time is recorded as Tstart and the second time is recorded as Tend; a communication protocol set between the control module and the tool face angle measurement module and a communication protocol set between the control module and the detection signal acquisition module are the same; and the time difference satisfies a conditional formula: Tdiff=Tend−Tstart.

In some embodiments, the first time is recorded as Tstart and the second time is recorded as Tend; a communication protocol set between the control module and the tool face angle measurement module is different from a communication protocol set between the control module and the detection signal acquisition module; and the time difference satisfies a conditional formula: Tdiff=Tend−Tstart−Tran2+Tran1, where Tran1 denotes a time when the tool face angle measurement module uploads the command that measurement has been started to the control module and decoding is performed, and Tran2 denotes a time when the detection signal acquisition module uploads the command that work has been started to the control module and decoding is performed.

In an embodiment, in the present disclosure, the control module in an electromagnetic central control board is connected to the detection signal acquisition module and the tool face angle measurement module through CAN buses. ID of the control module in the electromagnetic central control board is set as 0x00, ID of the tool face angle measurement module is set as 0x01, and ID of the detection signal acquisition module is set as 0x02. The detection signal acquisition module and the tool face angle measurement module transmit commands and data to a target ID (i.e., the control module in the electromagnetic central control board) through CAN buses.

Specific steps of a method for synchronizing detection signal acquisition data and tool face angle measurement data are as follows.

(1) After receiving azimuth measurement and acquisition commands given by an electromagnetic transmitting board, a control module in an electromagnetic central control board sends a measurement starting command 0x11 to a tool face angle measurement module with the ID of 0x01 through a CAN bus.

(2) The tool face angle measurement module receives the measurement starting command, then configures a measurement sensor, and retunes a command 0x12 that "the tool face angle measurement module" has started measurement to the control module with the ID of 0x00 in the electromagnetic central control board after completing the configuration, wherein a configuration time of the tool face angle measurement module is recorded as Tmcon, and a measurement starting time of a tool face angle is recorded as Mstart.

(3) The control module with the ID of 0x00 in the electromagnetic central control board receives the command 0x12 that measurement has been started and decodes it, records this period of time as Ttran1, then starts a timer to record a time, which is recorded as a first time Tstart, and meanwhile sends a detection signal acquisition starting command 0x21 to the detection signal acquisition module with the ID of 0x02.

(4) After receiving the detection signal acquisition starting command, the detection signal acquisition module starts to configure a corresponding channel and receiving mode; starts to acquire a detection signal, which is recorded as Cstart, after completing the configuration, Cstart denoting a starting time point when the detection signal acquisition module starts to acquire the detection signal; and meanwhile returns a command 0x22 that "the detection signal acquisition module" has started work to the control module with the ID of 0x00 in the electromagnetic central control board, a configuration time of the detection signal acquisition module being recorded as Tccon.

(5) The control module in the electromagnetic central control board receives the command 0x22 that work has been started and decodes it, records this period of time as Ttran2, and then stops the timer and records a measurement time, which is recorded as a second time Tend.

A starting time difference between a signal receiving module and an azimuth acquisition module is Tdiff=Cstart−Mstart, and $$T1=Tend-Tstart=Tdiff-Ttran1+Ttran2.$$

(6) If a communication protocol set between the control module in the electromagnetic central control board and the tool face angle measurement module and a communication protocol set between the control module in the electromagnetic central control board and the detection signal acquisition module are the same, that is, Ttran1 is equal to Ttran2, then Tdiff=Cstart−Mstart=Tend−Tstart=T1; and if used conununication modes are different, the time difference may be obtained through the formula Tdiff=T1−Tran2 Tran1 (T1=Tend−Tstart), wherein a time difference between Tran1 and Tran2 is a difference of times when command data is transmitted in the two connunication modes, Tran1 denotes a time when the tool face angle measurement module uploads the command that measurement has been started to the control module and decoding is performed, and Tran2 denotes a time when the detection signal acquisition module uploads the command that work has been started to the control module and decoding is performed.

(7) A rotating angular speed ωrad/s of an instrument within a preset time (the preset time includes less than Is and is recorded as Ts) is calculated according to acceleration sensor data in the tool face angle measurement module, and a deviation angle between tool face angle data and detection acquisition data is calculated according to the formula θ=ωt, where ω denotes the angular speed and t=Tdiff.

(8) The angle θ is synchronously subtracted from data uploaded by the tool face angle measurement module (a measurement module) within is to realize synchronization of the tool face angle data and the detection acquisition data.

(9) For data measured within next Is, operation procedures in steps (2) to (8) are continuously repeated to realize the purpose of synchronizing the tool face angle data and the electromagnetic signal acquisition data in real time.

In the present disclosure, the control module starts, according to the command that measurement has been started sent by the tool face angle measurement module, the timer to record the first time, and sends the detection signal acquisition starting command to the detection signal acquisition module. The detection signal acquisition module performs a parameter configuration according to the detection signal acquisition starting command, and sends the command that work has been started to the control module based on the configuration completion state. The control module stops the timer and records the second time according to the command that work has been started. The deviation angle is calculated according to the time difference between the first time and the second time, and the tool face angle measurement module is corrected based on the deviation angle. According to the present disclosure, time recording (the first time and the second time) is triggered based on the commands, which can accurately record a work ending time of the tool face angle measurement module and a work ending time of the detection signal acquisition module. Thus, a time difference between the tool face angle measurement module and the detection signal acquisition module is accurately calculated and the function of correcting a deviation amount (the deviation angle calculated based on the time difference) in real time is achieved to improve the azimuth measurement precision, thereby improving the geosteering precision of while-drilling instruments.

Compared with a correction method based on a fixed value, the synchronization method used in the present disclosure can precisely complete the time-shared control of two independent modules (the tool face angle measurement module and the detection signal acquisition module) in a measurement process, can also complete the precise measurement of a starting time difference of the two modules, and can achieve real-time data synchronization in combination with a current instantaneous rotating speed, thereby providing a better solution for high-precision measurement of the device for azimuth detection while drilling.

The present disclosure has been described with reference to the embodiments of the present disclosure. However, these embodiments are merely for the purpose of illustration and are not intended to limit the scope of the present disclosure. The scope of the present disclosure is subject to the appended claims and equivalents thereof. Those skilled in the art can make various replacements and modifications without departing from the scope of the present disclosure and these replacements and modifications should fall within the scope of the present disclosure.

What is claimed is:

1. A method for synchronizing azimuth detection data while drilling, comprising:

starting a timer by a control module to record a first time according to a measurement started command from a tool face angle measurement module, and sending a starting detection signal acquisition command to a detection signal acquisition module;

performing parameter configuration by the detection signal acquisition module according to the starting detection signal acquisition command, and sending a working started command to the control module based on the configuration completion status;

closing the timer and recording a second time by the control module according to the working started command; and calculating a deviation angle according to the time difference between the first time and the second time, and rectifying the tool face angle measurement module based on the deviation angle.

2. The method for synchronizing azimuth detection data while drilling according to claim 1, further comprising:

sending a starting measurement command by the control module to the tool face angle measurement module based on the received data acquisition command; and performing parameter configuration by the tool face angle measurement module according to the starting measurement command, and sending the measurement started command to the control module based on the configuration completion status.

3. The method for synchronizing azimuth detection data while drilling according to claim 1, wherein:

the first time is denoted as Tstart, and the second time is denoted as Tend; the same communication protocol is arranged between the control module and the tool face angle measurement module, and the detection signal acquisition module; and the time difference meets the conditional formula: Tdiff=Tend−Tstart.

4. The method for synchronizing azimuth detection data while drilling according to claim 1, wherein:

the first time is denoted as Tstart, and the second time is denoted as Tend; different communication protocols are arranged between the control module and the tool face angle measurement module, and the detection signal acquisition module; and the time difference meets the conditional formula: Tend−Tstart−Tran2+Tran1, wherein Tran1 represents the time when the tool face angle measurement module uploads the measurement started command to the control module and decodes the same, and Tran2 represents the time when the detection signal acquisition module uploads the working started command to the control module and decodes the same.

5. The method for synchronizing azimuth detection data while drilling according to claim 3, wherein:

the deviation angle is denoted as θ, and the deviation angle θ meets the conditional formula:

$\theta=\omega t$, wherein ω is an angular velocity, and $t$=Tdiff.

6. The method for synchronizing azimuth detection data while drilling according to claim 1, wherein the tool face angle measurement module is rectified based on the deviation angle, comprising:

performing the rectification by subtracting angle θ based on the data uploaded by the tool face angle measurement module within a preset time, to realize the synchronization of tool face angle data and detection signal data.

7. A device for synchronizing azimuth detection data while drilling, comprising a control module, a tool face angle measurement module and a detection signal acquisition module, wherein:

the control module starts a timer to record a first time according to a measurement started command from a tool face angle measurement module, and sends a starting detection signal acquisition command to a detection signal acquisition module;

the detection signal acquisition module performs parameter configuration according to the starting detection signal acquisition command, and sends the working started command to the control module based on the configuration completion status;

the control module closes the timer and records a second time according to the working started command; and a deviation angle is calculated according to the time difference between the first time and the second time, and the tool face angle measurement module is rectified based on the deviation angle.

8. The device for synchronizing azimuth detection data while drilling according to claim 7, wherein:

the control module sends a starting measurement command to the tool face angle measurement module based on the received data acquisition command; and the tool face angle measurement module performs parameter configuration according to the starting measurement command, and sends the measurement started command to the control module based on the configuration completion status.

9. The device for synchronizing azimuth detection data while drilling according to claim 7, wherein:

the first time is denoted as Tstart, and the second time is denoted as Tend; the same communication protocol is arranged between the control module and the tool face angle measurement module, and the detection signal acquisition module; and the time difference meets the conditional formula: Tdiff=Tend−Tstart.

10. The device for synchronizing azimuth detection data while drilling according to claim 7, wherein:

the first time is denoted as Tstart, and the second time is denoted as Tend; different communication protocols are arranged between the control module and the tool face angle measurement module and, the detection signal acquisition module; and the time difference meets the conditional formula: Tdiff=Tend−Tstart−Tran2+Tran1, wherein Tran1 represents the time when the tool face angle measurement module uploads the measurement started command to the control module and decodes the same, and Tran2 represents the time when the detection signal acquisition module uploads the working started command to the control module and decodes the same.

11. The method for synchronizing azimuth detection data while drilling according to claim 4, wherein:

the deviation angle is denoted as θ, and the deviation angle θ meets the conditional formula:

$\theta=\omega t$, wherein ω is an angular velocity, and $t$=Tdiff.

* * * * *